US009298150B2

(12) United States Patent
Uwatoko

(10) Patent No.: US 9,298,150 B2
(45) Date of Patent: Mar. 29, 2016

(54) FAILURE PREDICTIVE SYSTEM, AND FAILURE PREDICTIVE APPARATUS

(71) Applicant: FUJI XEROX CO., LTD., Tokyo (JP)

(72) Inventor: Koki Uwatoko, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/487,665

(22) Filed: Sep. 16, 2014

(65) Prior Publication Data

US 2015/0227100 A1 Aug. 13, 2015

(30) Foreign Application Priority Data

Feb. 13, 2014 (JP) ..... 2014-025224

(51) Int. Cl.
*G03G 15/00* (2006.01)

(52) U.S. Cl.
CPC ..... *G03G 15/55* (2013.01)

(58) Field of Classification Search
CPC ..... G03G 15/55
USPC ..... 399/9
See application file for complete search history.

(56) References Cited

U.S. PATENT DOCUMENTS

| | | | |
|---|---|---|---|
| 8,175,849 | B2 * | 5/2012 | Yamashita et al. |
| 8,405,854 | B2 * | 3/2013 | Matsuda et al. |
| 2005/0027486 | A1 * | 2/2005 | Kitada et al. |
| 2009/0319827 | A1 * | 12/2009 | Nakazato et al. |
| 2010/0094594 | A1 | 4/2010 | Yamashita et al. |
| 2010/0322640 | A1 * | 12/2010 | Yamada |
| 2015/0132017 | A1 * | 5/2015 | Imazeki et al. |

FOREIGN PATENT DOCUMENTS

| | | | |
|---|---|---|---|
| JP | 2007199976 A | * | 8/2007 |
| JP | A-2009-3561 | | 1/2009 |
| JP | 2009252137 A | * | 10/2009 |
| JP | A-2010-91840 | | 4/2010 |

* cited by examiner

*Primary Examiner* — Susan Lee
(74) *Attorney, Agent, or Firm* — Oliff PLC

(57) ABSTRACT

Provided is a failure predictive system, including a storage unit that stores a first model, a second model, and a third model, which are models prepared in advance based on data acquired with respect to one or more monitored apparatuses, an acquiring unit that acquires data of the control parameters and the data of the usages with respect to the monitored apparatus which is a failure predictive object, and a calculation unit that calculates a failure occurrence probability of the monitored apparatus which is the failure predictive object based on the data of the control parameters and the data of the usages acquired by the acquiring unit, and the first to the third models stored in the storage unit.

19 Claims, 6 Drawing Sheets

FIG. 4A

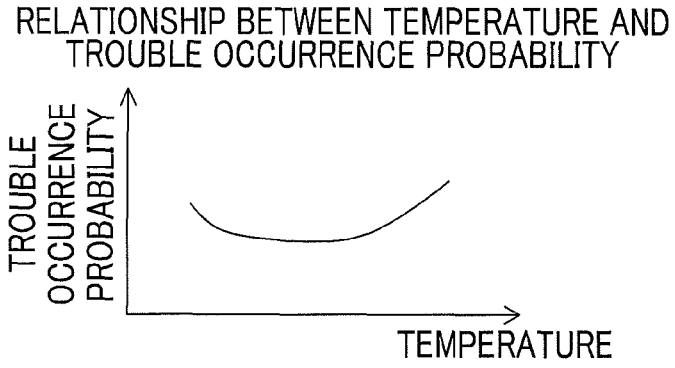

FIG. 4B

CROSS-TABULATION TABLE OF TROUBLE OCCURRENCE PROBABILITY BASED ON TEMPERATURE AND HUMIDITY

| TEMPERATURE | $x < \alpha_1$ | | | $\alpha_1 \leqq x < \alpha_2$ | | | $\alpha_2 \leqq x$ | | |
|---|---|---|---|---|---|---|---|---|---|
| HUMIDITY | $y < \beta_1$ | $\beta_1 \leqq y < \beta_2$ | $\beta_2 \leqq y$ | $y < \beta_1$ | $\beta_1 \leqq y < \beta_2$ | $\beta_2 \leqq y$ | $y < \beta_1$ | $\beta_1 \leqq y < \beta_2$ | $\beta_2 \leqq y$ |
| TROUBLE OCCURRENCE PROBABILITY | 15% | 10% | 25% | 10% | 5% | 15% | 20% | 12% | 40% |
| TROUBLE NONOCCURRENCE PROBABILITY | 85% | 90% | 75% | 90% | 95% | 85% | 80% | 88% | 60% |

FAILURE PREDICTIVE SYSTEM, AND FAILURE PREDICTIVE APPARATUS

CROSS-REFERENCE TO RELATED APPLICATIONS

This application is based on and claims priority under 35 USC 119 from Japanese Patent Application No. 2014-025224 filed Feb. 13, 2014.

BACKGROUND (i) Technical Field

The present invention relates to a failure predictive system, and a failure predictive apparatus.

(ii) Related Art

As an image forming apparatus having a function of forming an image on a recording material such as sheet, a copying machine, a printer apparatus, a facsimile apparatus, a multifunction machine combined with the functions thereof, and the like are known.

In such an image forming apparatus, when a failure (including a fault or malfunction) which poses an obstacle to an operation thereof occurs, it is inconvenient for a user of the image forming apparatus. Therefore, there is a demand for reducing a time taken to be in a state in which the image forming apparatus is constrained from being used by predicting a failure occurrence in the image forming apparatus, and by performing a necessary process such as component replacement or repair before the failure occurrence or immediately after the failure occurrence.

Up to now, various technologies with respect to failure prediction of an apparatus such as an image forming apparatus as an object have been proposed.

SUMMARY

According to an aspect of the invention, there is provided a failure predictive system, including:

a storage unit that stores a first model indicating a first data trend of control parameters used in operation control by a monitored apparatus when a failure occurs in the monitored apparatus, a second model indicating a second data trend of control parameters when the failure does not occur in the monitored apparatus, and a third model indicating a relationship between data of usages of the monitored apparatus and a probability of a failure occurred in the monitored apparatus, which are models prepared in advance based on data acquired with respect to one or more monitored apparatuses;

an acquiring unit that acquires data of the control parameters and the data of the usages with respect to the monitored apparatus which is a failure predictive object; and a calculation unit that calculates a failure occurrence probability of the monitored apparatus which is the failure predictive object based on the data of the control parameters and the data of the usages acquired by the acquiring unit, and the first to the third models stored in the storage unit.

BRIEF DESCRIPTION OF THE DRAWINGS

Exemplary embodiments of the present invention will be described in detail based on the following figures, wherein:

FIG. 4A is a graphic chart illustrating an example in which a difference in usages affects a trouble occurrence probability, and FIG. 4B is a table illustrating an example in which the difference in the usages affects the trouble occurrence probability;

DETAILED DESCRIPTION

An exemplary embodiment of the invention will be described with reference to the drawings.

Figure 1:
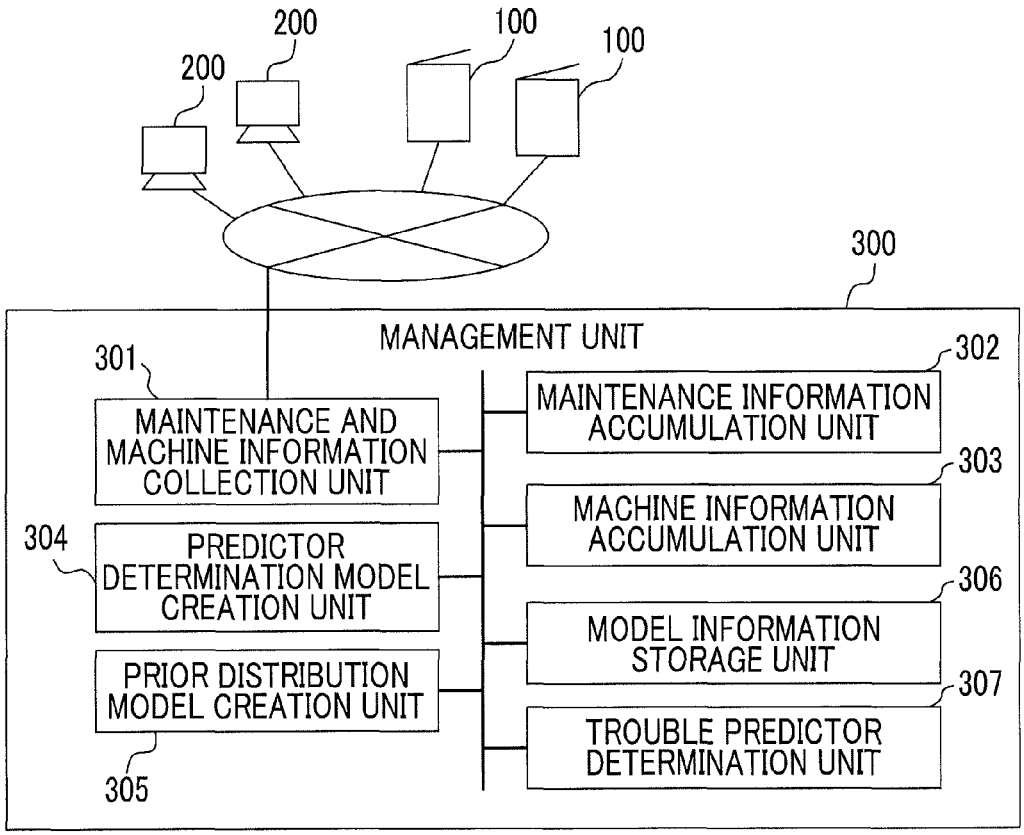
FIG. 1 is a diagram illustrating a configuration example of a failure predictive system according to an exemplary embodiment of the invention.

In FIG. 1, a configuration example of a failure predictive system according to the exemplary embodiment of the invention is illustrated.

The failure predictive system of this example includes an image forming apparatus 100 which forms an image on a recording material such as a sheet and outputs the recording material having the image thereon, and a maintenance information input terminal 200 used by a manager, a person in charge of a maintenance operation, or the like of the image forming apparatus 100. In an example of FIG. 1, two image forming apparatuses 100 and two maintenance information input terminals 200 are illustrated, but any number of image forming apparatuses 100 and maintenance information input terminals may be used.

In addition, the failure predictive system of this example includes a management unit 300 which is connected to each of the image forming apparatuses 100 and the maintenance information input terminals 200 to be able to perform wired or wireless communication with each other. The management unit 300 calculates a failure (a trouble) occurrence probability (a trouble occurrence predictor probability) of the image forming apparatus 100 in the near future by using information collected from the subject image forming apparatus 100 and the subject maintenance information input terminal 200.

The image forming apparatus 100 is an apparatus which performs an image forming process for forming an image on a recording material such as a sheet. Hereinafter, as the image forming apparatus 100, a printer for executing a printing process based on a printing job is described as an example. Here, the printing job is a data unit for the image forming apparatus 100 to perform the printing process, and is configured by printing object data (data such as a character, a diagram, and an image), setting data (for example, the number of printed sheets, both surfaces/one surface, color/black and white) at the time of performing printing, or the like. Furthermore, as the image forming apparatus 100, an apparatus such as a copying machine, and a facsimile apparatus is included in addition to the printer described above, and a multifunction machine combined with the functions thereof is also included.

The image forming apparatus 100 of this example includes plural control parameters used in an operation of the image forming process, and the control parameters are suitably adjusted at the time of performing the image forming process.

In addition, the image forming apparatus 100 of this example has a function of setting the control parameter which is able to contribute to a prediction of a trouble occurrence among the control parameters as monitoring parameters, of detecting a value thereof, and of providing the value to the management unit 300. As the monitoring parameters, for example, a charging voltage, a development bias, an intensity of laser light, a toner density, and the like are included.

As a detection value of the monitoring parameters, a measurement value measured with respect to a portion of a control object according to the monitoring parameters may be used, an aim value which is a control aim of the portion may be used, a computation value of a difference or the like between the measurement value and the aim value may be used, and various values with respect to control of the monitoring parameters may be used.

A detection of a value of the monitoring parameters is implemented at a predefined timing, for example, at a timing such as a timing of every printing of one sheet, a timing of every printing job in which printing outputs of one or plural pages are collected, and a timing of every elapsing of a set time period (for example, 5 minutes).

In addition, the image forming apparatus 100 of this example has a function of detecting usages of an own device. The usages indicate situations of how the own device is used, and the usages of the image forming apparatus 100 of this example is able to be broadly classified into a situation (an external situation) of a usage environment such as temperature or humidity inside (or outside) the image forming apparatus 100, and a situation (an internal situation) of a usage load such as the number of printed sheets (the number of black and white printed sheets, the number of color printed sheets, and the total number of printed sheets) or the number of printed characters by the image forming apparatus 100.

In this example, a detection of the usages is performed at the same timing as the detection of the value of the monitoring parameters, but the detection of the usages may be performed at a different timing.

In addition, the image forming apparatus 100 of this example transmits the monitoring parameters and a detection value of the usages of the apparatus to the management unit 300 as machine information, along with an apparatus ID for identifying the image forming apparatus 100, a detection date and time, and the like. Transmission of the machine information to the management unit 300 may be autonomously performed by the image forming apparatus 100, and may be performed according to a request from the management unit 300.

The maintenance information input terminal 200 receives an input of maintenance information with respect to an implemented maintenance operation from a person in charge of actually performing a nonperiodic maintenance operation by visiting an installation site of the image forming apparatus 100 according to a request from a user or a person who receives a report. As the input maintenance information, for example, an implementation date and time of the maintenance operation, an apparatus ID for identifying the image forming apparatus 100 which is an object of the maintenance operation, a trouble ID for identifying a type of trouble handled by the maintenance operation, and the like are included. That is, the maintenance information is also referred to as information of a trouble occurrence case.

In addition, the maintenance information input terminal 200 of this example transmits the input maintenance information to the management unit 300. Transmission of the maintenance information to the management unit 300 may be autonomously performed by the maintenance information input terminal 200, and may be performed according to a request from the management unit 300.

The management unit 300 of this example is an apparatus for calculating the trouble occurrence predictor probability of the image forming apparatus 100, and includes a maintenance and machine information collection unit 301, a maintenance information accumulation unit 302, a machine information accumulation unit 303, a predictor determination model creation unit 304, a prior distribution model creation unit 305, a model information storage unit 306, and a trouble predictor determination unit 307.

The maintenance and machine information collection unit 301 receives (acquires) the machine information (the monitoring parameters and the detection value of the usages of the apparatus, the apparatus ID, the detection date and time, or the like) from the image forming apparatus 100, and stores the information in the machine information accumulation unit 303.

In addition, the maintenance and machine information collection unit 301 receives (acquires) the maintenance information (the implementation date and time of the maintenance operation, the apparatus ID, the trouble ID, or the like) from the maintenance information input terminal 200, and stores the information in the maintenance information accumulation unit 302.

The predictor determination model creation unit 304 creates a predictor determination model based on the maintenance information accumulated in the maintenance information accumulation unit 302 and the machine information accumulated in the machine information accumulation unit 303. The predictor determination model created by the predictor determination model creation unit 304 is stored in the model information storage unit 306, and is used in the trouble predictor determination unit 307 at the time of calculating the trouble occurrence predictor probability.

The prior distribution model creation unit 305 creates a prior distribution model based on the maintenance information accumulated in the maintenance information accumulation unit 302 and the machine information accumulated in the machine information accumulation unit 303. The prior distribution model created by the prior distribution model creation unit 305 is stored in the model information storage unit 306, and is used in the trouble predictor determination unit 307 at the time of calculating the trouble occurrence predictor probability.

The trouble predictor determination unit 307 calculates the trouble occurrence predictor probability of the image forming apparatus 100 based on the most recent machine information accumulated in the machine information accumulation unit 303 with respect to the image forming apparatus 100 which is a failure predictive object, and the predictor determination model and the prior distribution model stored in the model information storage unit 306.

Figure 2:
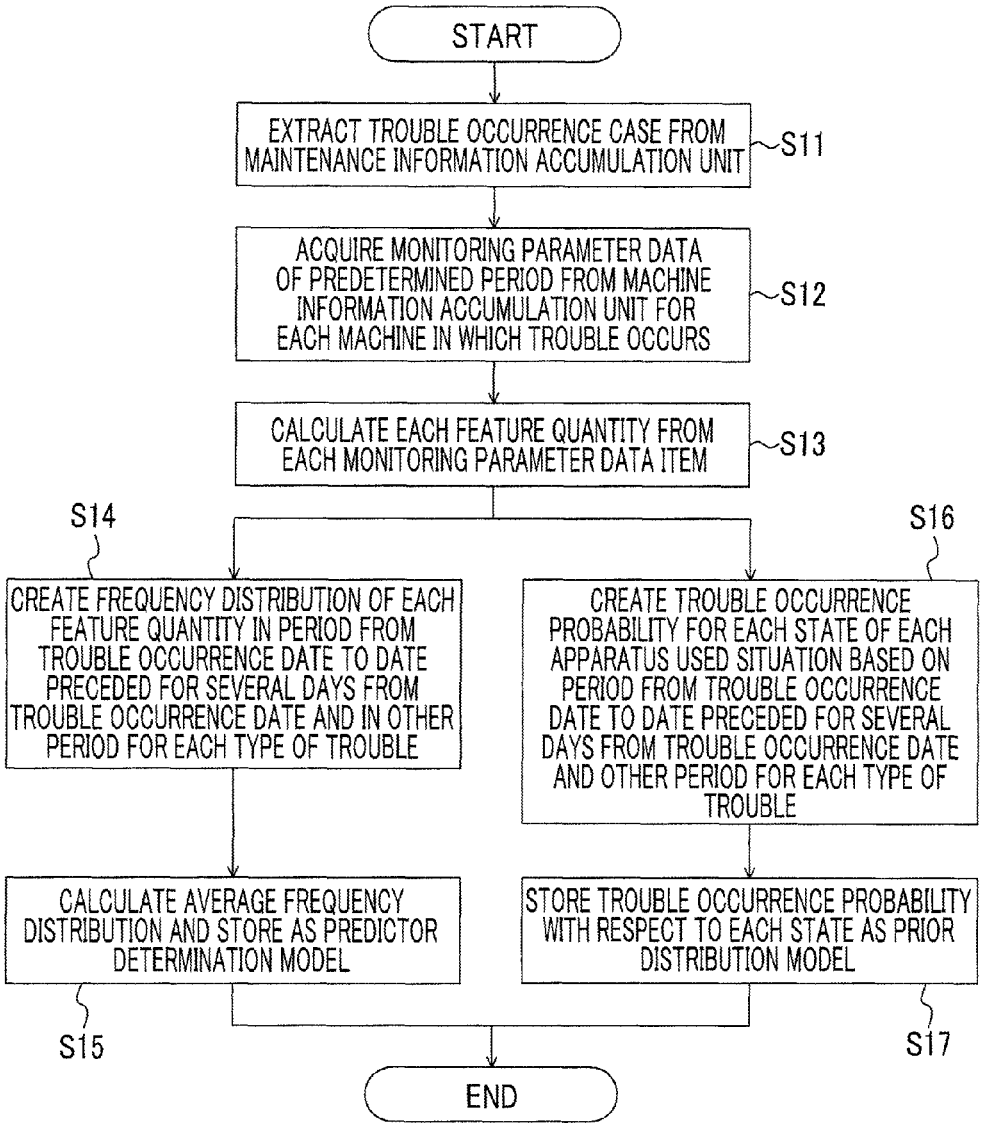
FIG. 2 is a diagram illustrating an example of a processing flow for creating a trouble determination model and a prior distribution model.

Creation of the predictor determination model and the prior distribution model by the predictor determination model creation unit 304 and the prior distribution model creation unit 305 will be described with reference to a processing flow illustrated in FIG. 2.

First, the trouble occurrence case (the maintenance information) is extracted with reference to the maintenance information accumulation unit 302 (Step S11).

Next, with reference to the machine information of the machine information accumulation unit 303 which corresponds to the trouble occurrence case (the maintenance information), data of the monitoring parameters in which a correspondence with the type of trouble occurred in the apparatus is set in advance (which is able to contribute to the prediction of the trouble occurrence) is acquired by a period $\Delta T_1$ unit, and data of the usages is acquired by the period $\Delta T_1$ unit, with respect to the image forming apparatus 100 in which the trouble occurs (the maintenance operation is performed) (Step S12).

Furthermore, the period $\Delta T_1$ may be any period, and a relatively short period (for example, a one job unit, a several jobs unit, a one day unit, and a several days unit) may be used.

Here, as the data of the monitoring parameters, for example, data such as a charging voltage, a development bias, and an intensity of laser light is acquired when an image quality trouble related to a density fluctuation is an object.

In addition, as the data of the usages, for example, data such as average temperature and average humidity is acquired with respect to the situation of the usage environment, and data such as average number of printed sheets per unit days, an average ratio of color printing to black and white printing per unit days, and an average ratio of printed characters per unit days is acquired with respect to the situation of the usage load.

Next, feature quantities of the data of the monitoring parameters acquired in the period $\Delta T_1$ unit with respect to the type of trouble occurred in the apparatus is calculated for each image forming apparatus 100 by using one or plural feature quantity calculating sections (not illustrated) prepared in advance for each type of trouble (Step S13).

As the feature quantity of the data of the monitoring parameters, a standard deviation of the data of the monitoring parameters in a period of the job unit or the one day unit, a correlation coefficient of a data transition between the monitoring parameters in a period of the several jobs unit or the several days unit, and the like are included. In this example, for each type of trouble, plural types of feature quantity which are assumed to be characteristically changed in association with the occurrence of the type of trouble are defined in advance and each feature quantity corresponding to the type of trouble which is the object is separately calculated.

Next, for each image forming apparatus 100, a distribution (a histogram) of frequency values of the feature quantity in a period $\Delta T_2$ which is preceded for a predetermined period from a trouble occurrence date and time and a distribution (a histogram) of frequency values of the feature quantity in the other period (a period during which the trouble does not occur) are prepared with respect to each feature quantity corresponding to the type of trouble occurred in the apparatus, and the frequency value is normalized (Step S14).

Figure 3A:
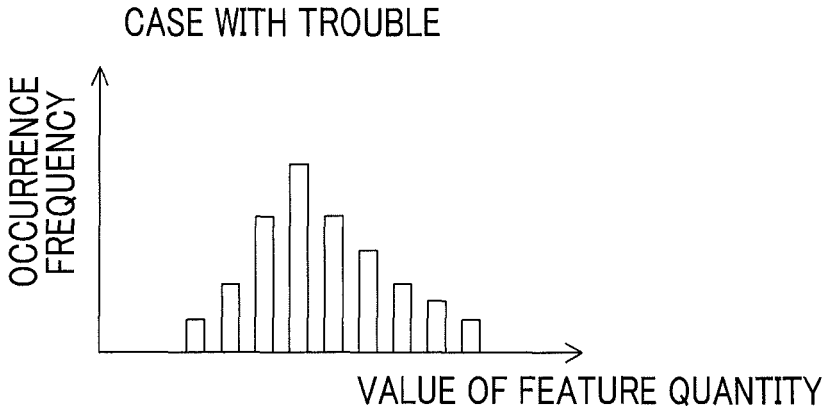
FIG. 3A is a diagram illustrating an example of a frequency distribution of calculation values of feature quantities in a period during which a trouble occurs.
Figure 3B:
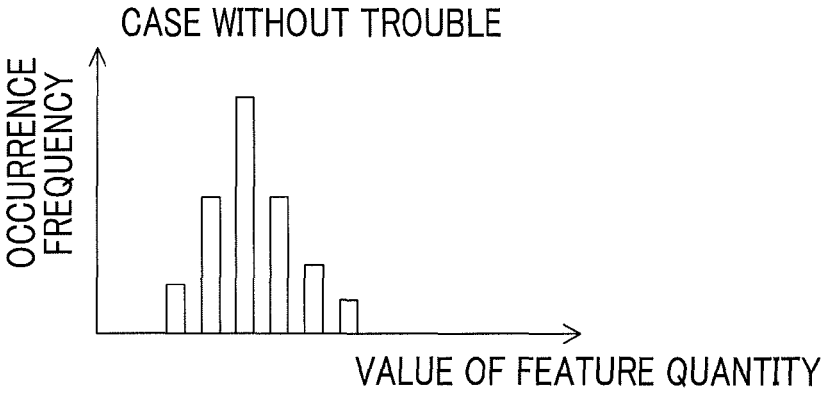
FIG. 3B is a diagram illustrating an example of a frequency distribution of calculation values of feature quantities in a period during which the trouble does not occur.

That is, a frequency distribution with trouble (a frequency distribution of the feature quantity in a period during which the trouble occurs) as illustrated in FIG. 3A, and a frequency distribution without trouble (a frequency distribution of the feature quantity in a period during which the trouble does not occur) as illustrated in FIG. 3B are prepared for each image forming apparatus 100 and for each feature quantity corresponding to the type of trouble occurred in the apparatus. Furthermore, the frequency distribution of the feature quantity is able to be prepared by counting the number of items (the frequency values) of the feature quantity for each interval in which a range of acquisition values of the feature quantity is partitioned with a constant width.

Here, any length of $\Delta T_2$ may be used, and a period (for example, 5 days) which is longer than at least $\Delta T_1$ may be used.

Furthermore, in order to correct an irregularity of the feature quantity between the apparatuses, an average value and a standard deviation of each feature quantity for each image forming apparatus 100 may be calculated, and the feature quantity may be standardized, and thus the frequency distribution may be prepared.

Then, for each type of trouble, the frequency distribution after normalization with trouble which is separately prepared with respect to all of the image forming apparatuses 100 is averaged for each feature quantity to be created as an error time model, the frequency distribution after normalization without trouble which is separately prepared with respect to all of the image forming apparatuses 100 is averaged for each feature quantity to be created as a normal time model, and the error time model and the normal time model are stored in the model information storage unit 306 as the predictor determination model (Step S15).

Thus, in this example, for each type of trouble, the error time model indicating a data trend of the monitoring parameters when the trouble occurs, and the normal time model indicating a data trend of the monitoring parameters when the trouble does not occur are created, and the models are stored in the model information storage unit 306 as the predictor determination model.

In addition, for each combination of the usages in a classification unit in which a value acquired by each usage is divided into plural values, the trouble occurrence probability (a probability of a trouble occurred) for each type of trouble of the image forming apparatus 100 in a state where the usages are coincident with the combination in the period $\Delta T_2$ is calculated based on data of plural usages (the situation of the usage environment and the situation of the usage load) acquired with respect to each image forming apparatus 100 (Step S16).

That is, as illustrated in FIGS. 4A and 4B, a difference between the usages (FIG. 4A is an example of temperature) affects the trouble occurrence probability, and thus it is possible to calculate the trouble occurrence probability with respect to the state where the usages are coincident with the combination for each combination in which each usage divided by a predetermined unit is cross-tabulated such that the trouble occurrence predictor probability of the image forming apparatus 100 which is the failure predictive object is able to be calculated by adding the difference. For example, as illustrated in a table of FIG. 4B, for each combination in which the temperature and the humidity are respectively divided by a certain unit, the trouble occurrence probability of the image forming apparatus 100 in the state where the temperature and the humidity are coincident with the combination is calculated, and a cross-tabulation table is prepared. In the cross-tabulation table of FIG. 4B, temperature x is divided into 3 steps ($x<\alpha_1$, $\alpha_1 \leq x<\alpha_2$, and $\alpha_2 \leq x$) by using reference values $\alpha_1$ and $\alpha_2$, humidity y is divided into 3 steps ($y<\beta_1$, $\beta_1 \leq y<\beta_2$, and $\beta_2 \leq y$) by using reference values $\beta_1$ and $\beta_2$, and a calculation value of the trouble occurrence probability (and a trouble nonoccurrence probability (=100%−a trouble occurrence probability)) is set for each combination.

Then, the cross-tabulation table of the trouble occurrence probability created for each type of trouble is stored in the model information storage unit 306 as the prior distribution model (Step S17).

Thus, in this example, for each type of trouble, the prior distribution model which indicates a relationship between the data of the usages of the image forming apparatus 100 and the probability of the failure occurred in the monitored apparatus is created, and is stored in the model information storage unit 306.

Here, in this example, the predictor determination model creation unit 304 and the prior distribution model creation unit 305 newly prepare the predictor determination model (the error time model and the normal time model) and the prior distribution model on a regular basis and change stored contents of the model information storage unit 306, and it is not necessary that update timings thereof should be the same time. For example, an update of the predictor determination model may be performed at a timing such as once every three months, and once every half year according to a frequency of the trouble occurrence case (the maintenance information) to be accumulated, for each type of trouble. In addition, regarding the situation of the usage load in the usages, an update of the prior distribution model may be performed at a timing such as once every month as fineness in which a variation of the number of printed sheets is captured, and regarding the situation of the usage environment in the usages, the update of the prior distribution model may be performed at a timing such as once every year such that seasonal factors are reflected.

Figure 5:
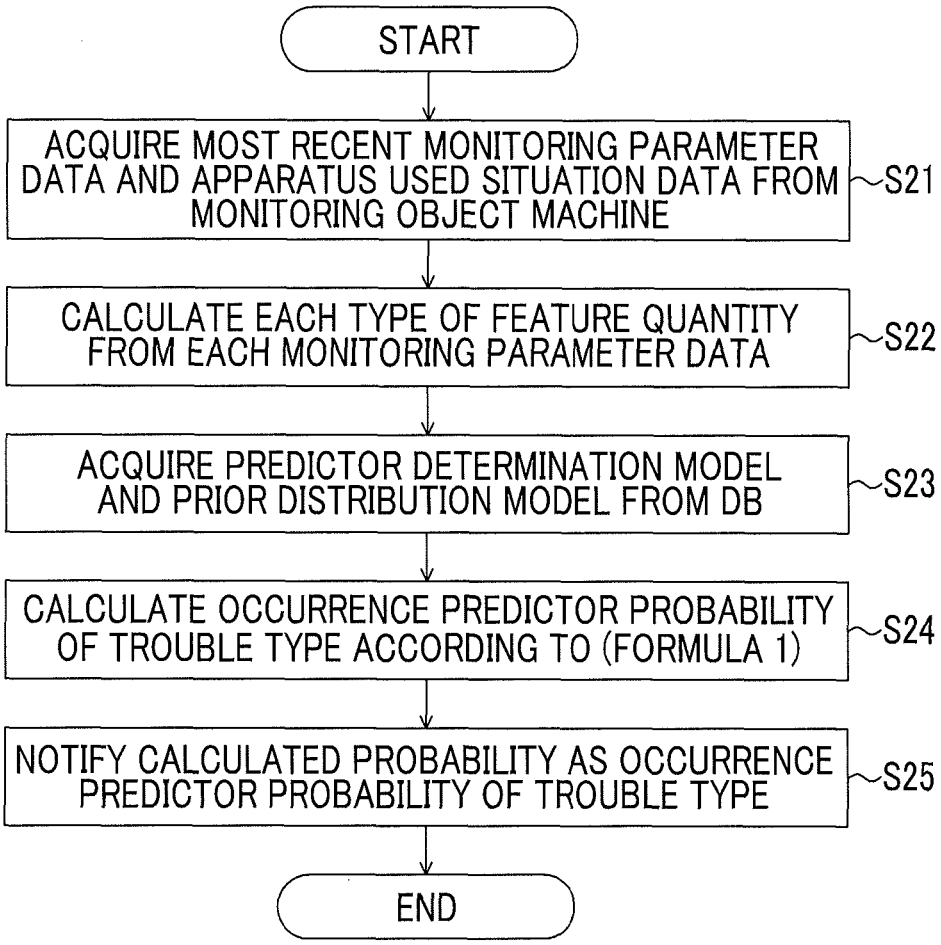
FIG. 5 is a diagram illustrating an example of a processing flow for calculating a trouble occurrence predictor probability.

A calculation of the trouble occurrence predictor probability by the trouble predictor determination unit 307 will be described with reference to a processing flow illustrated in FIG. 5. Furthermore, in FIG. 6, the calculation of the trouble occurrence predictor probability by the trouble predictor determination unit 307 is conceptually illustrated.

First, the data of the monitoring parameters necessary for a calculation of the feature quantity is acquired and the data of the usages is acquired with respect to the image forming apparatus 100 which is the failure predictive object with reference to the most recent machine information accumulated in the machine information accumulation unit 303 (Step S21).

Next, each feature quantity is calculated by the same method as that in the creation of the predictor determination model (Step S22).

Next, for each type of trouble, the predictor determination model and the prior distribution model which correspond to the type of trouble are acquired from the model information storage unit 306 (Step S23).

Then, the trouble occurrence probability (the trouble occurrence predictor probability) of the image forming apparatus 100 in the near future is calculated according to the following formula (Formula 1) based on each information item, the predictor determination model, and the prior distribution model obtained with respect to the image forming apparatus 100 which is the failure predictive object (Step S24).

In this example, the type of trouble of the failure predictive object is set to a trouble T, each value of n-types of feature quantity $X_i$ ($1 \le i \le n$) related to the trouble T obtained from the most recent machine information in the image forming apparatus 100 which is the failure predictive object is set to $x_i$, the combination of m-types of usage $s_j$ ($1 \le j \le m$) obtained from the machine information is set to a state S, and a trouble T occurrence probability of the image forming apparatus 100 which is the failure predictive object is calculated according to Formula 1. Furthermore, Formula 1 is premised on the fact that there is no correlation between the respective feature quantities.

$$P((T=\text{yes}) \mid x_1, x_2, \ldots, x_n, S) = \frac{\left(P(T=\text{yes} \mid S) \cdot \prod_{i=1}^{n} P(x_i \mid (T=\text{yes}))\right)}{P(T=\text{yes} \mid S) \cdot \prod_{i=1}^{n} P(x_i \mid (T=\text{yes})) + P(T=no \mid S) \cdot \prod_{i=1}^{n} P(x_i \mid (T=\text{no}))} \quad (1)$$

Here, P(T=yes|(S) is a probability of a trouble T occurred (a prior probability) when the usages of the image forming apparatus 100 are in the state S, and P(T=no|S) is a probability of the trouble T not occurred (a prior probability) when the usages of the image forming apparatus 100 are in the state S. Furthermore, there is a relationship of P(T=yes|S)+P(T=no|S)=1.

In addition, $P(x_i|(T=\text{yes}))$ is a probability in which a value of an i-th feature quantity $X_i$ is $x_i$ when the trouble T occurs, and a probability of $x_i$ in a trouble type determination probability distribution (with trouble) with respect to the feature quantity $X_i$ corresponding to the trouble T is used.

In addition, $P(x_i|(T=\text{no}))$ is a probability in which the value of the i-th feature quantity $X_i$ is $x_i$ when the trouble T does not occur, and a probability of $x_i$ in a trouble type determination probability distribution (without trouble) with respect to the feature quantity $X_i$ corresponding to the trouble T is used.

That is, in Formula 1, by using the probability of the trouble T occurred (the prior probability) when the usages of the image forming apparatus 100 are in the state S, the value $[P(T=\text{yes}|S) \cdot \Pi P(x_i|(T=\text{yes}))]$ multiplied by a probability of a combination such as ($x_1$, $x_2$, . . . , and $x_n$) to be obtained as each value of the n-types of feature quantity $X_i$ ($1 \le i \le n$) when the trouble T occurs, the probability of the trouble T not occurred (the prior probability) when the usages of the image forming apparatus 100 are in the state S, and the value $[P(T=\text{no}|S) \cdot \Pi P(x_i|(T=\text{no}))]$ multiplied by a probability of the combination such as ($x_1$, $x_2$, . . . , and $x_n$) to be obtained as each value of the n-types of feature quantity $X_i$ ($1 \le i \le n$) when the trouble T does not occur, the trouble T occurrence probability $[P((T=\text{yes})|x_1, x_2, \ldots, \text{and } x_n, \text{and } S)]$ of the image forming apparatus 100 which is the failure predictive object is calculated.

Figure 6:
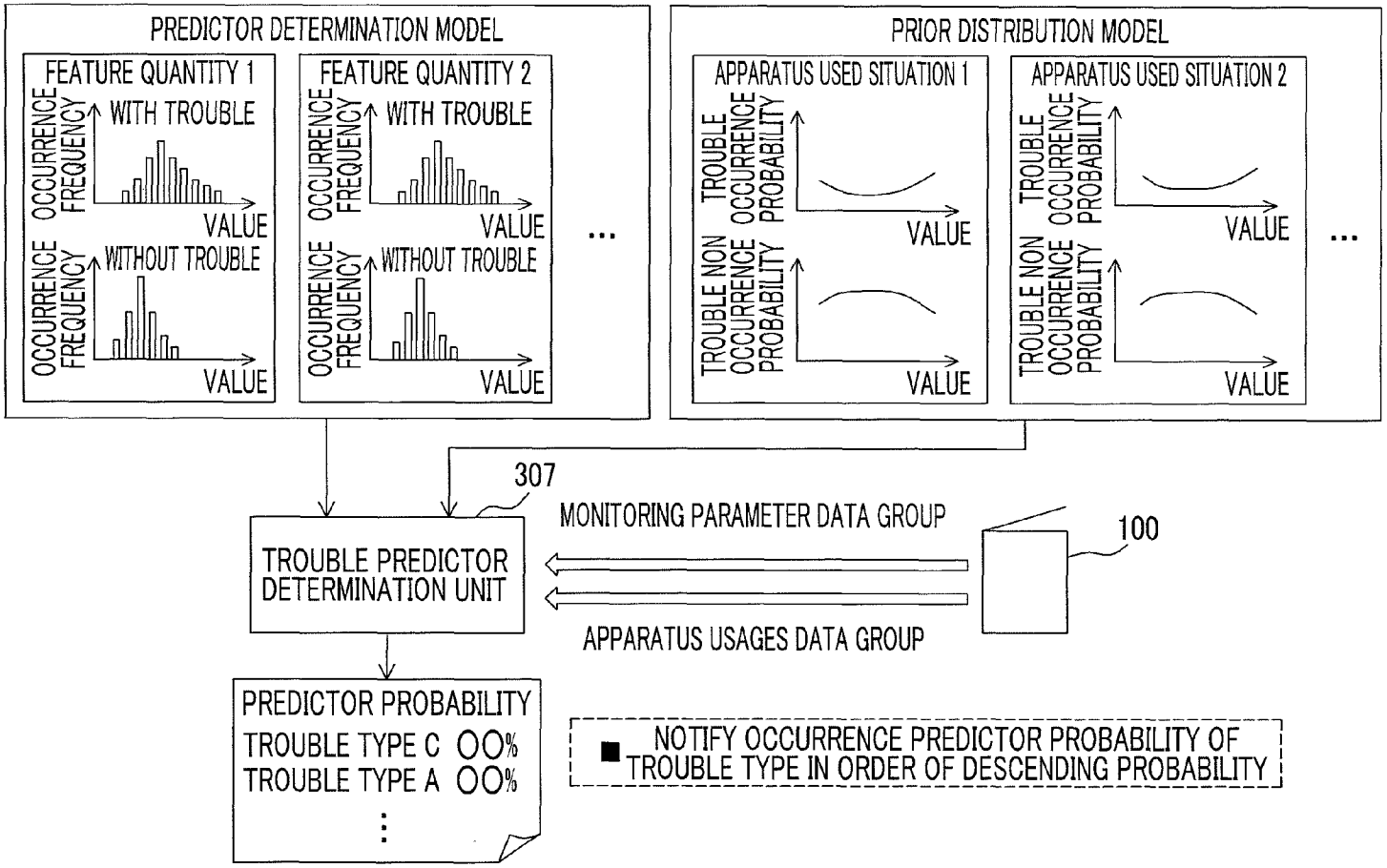
FIG. 6 is a diagram conceptually illustrating a process for calculating the trouble occurrence predictor probability.

When the management unit 300 of this example calculates the trouble occurrence predictor probability with respect to the image forming apparatus 100 which is the failure predictive object for each type of trouble as illustrated in FIG. 6, the manager, the person in charge of the maintenance operation, or the like of the image forming apparatus 100 is notified of the calculation result. A notification of the calculation result may be performed by various methods such as mail transmission to a corresponding person, and display output by the maintenance information input terminal 200 used by the corresponding person.

In addition, in this example, the entirety of trouble occurrence predictor probabilities calculated for each type of trouble are notified in an order of descending probability, but a selective notification such as a notification of only the trouble occurrence predictor probability which is over a predetermined threshold value, or a notification of only the trouble occurrence predictor probability of the predetermined number from an upper level may be performed.

As described above, in the failure predictive system of this example, in the management unit 300, the model information storage unit 306 stores the error time model indicating the data trend of the monitoring parameters when the trouble occurs in the image forming apparatus 100, the normal time model indicating the data trend of the monitoring parameters when the trouble does not occur in the image forming apparatus 100, and the prior distribution model indicating the relationship between the data of the usages of the image forming apparatus 100 and the probability of the failure occurred in the monitored apparatus, the maintenance and machine information collection unit 301 acquires the machine information (the data of the monitoring parameters and the data of the usages) from the image forming apparatus 100 which is the failure predictive object, and the trouble predictor determination unit 307 calculates the failure occurrence probability (the trouble occurrence predictor probability) of the image forming apparatus 100 which is the failure predictive object based on the acquired data of the monitoring parameters and usages, and the error time model, the normal time model, and the prior distribution model which are stored in the model information storage unit 306.

More specifically, the trouble predictor determination unit 307 calculates the trouble occurrence predictor probability as follows.

That is, the probability [$\Pi P(x_i|(T=yes))$] of the data of the monitoring parameters of the image forming apparatus 100 in which the trouble occurs being in the same trend as that of the data of the monitoring parameters acquired from the image forming apparatus 100 which is the failure predictive object is computed by using the error time model.

In addition, the probability [$\Pi P(x_i|(T=No))$] of the data of the monitoring parameters of the image forming apparatus 100 in which the trouble does not occur being in the same trend as that of the data of the monitoring parameters acquired from the image forming apparatus 100 which is the failure predictive object is computed by using the normal time model.

In addition, a probability of a failure occurred [$P(T=yes|S)$] and a probability of the failure not occurred [$P(T=No|S)$] are computed by using the prior distribution model under the same condition as that of the data of the usages acquired from the image forming apparatus 100 which is the failure predictive object.

Then, based on a computation result thereof, the trouble occurrence predictor probability is calculated according to Formula 1.

Accordingly, the trouble occurrence predictor probability of the image forming apparatus 100 which is the failure predictive object is able to be adjusted according to the trouble occurrence probability of the image forming apparatus 100 in the same usage as that of the image forming apparatus 100, and thus it is possible to more accurately calculate the trouble occurrence predictor probability.

In addition, in the failure predictive system of this example, the cross-tabulation table associated with the probability of the failure occurred in the image forming apparatus 100 in which the data of the usages is coincident with the combination for each combination of the usages in a unit in which a value acquired by each type of data is divided into plural values based on the data of plural types of usage is used as the prior distribution model.

Accordingly, it is possible to reduce a data amount of the prior distribution model, or to reduce the processing load related to the calculation of the trouble occurrence predictor probability, and to more accurately calculate the trouble occurrence predictor probability.

In addition, in the failure predictive system of this example, the model information storage unit 306 stores each of the error time model, the normal time model, and the prior distribution model for each type of trouble, and the trouble predictor determination unit 307 calculates the trouble occurrence predictor probability for each type of trouble by each model corresponding to the type of trouble.

Accordingly, the trouble occurrence predictor probability of the image forming apparatus 100 which is the failure predictive object is able to be grasped for each type of trouble.

In addition, in the predictive system of this example, based on the data (the maintenance information and the machine information) which is collected from the subject image forming apparatus 100 and the maintenance information input terminal 200 by the maintenance and machine information collection unit 301 and accumulated in the maintenance information accumulation unit 302 and the machine information accumulation unit 303, and the predictor determination model creation unit 304 prepares the predictor determination model (the error time model and the normal time model), in addition, the prior distribution model creation unit 305 prepares the prior distribution model, and the models are stored in the model information storage unit 306.

Accordingly, it is possible to suitably update each model used in the calculation of the trouble occurrence predictor probability, and thus it is possible to improve calculation accuracy of the trouble occurrence predictor probability.

Here, the management unit 300 of this example is realized by a computer including a main memory device such as a Central Processing Unit (CPU) for performing various computing processes, a Random Access Memory (RAM) which is a working region of the CPU, or a Read Only Memory (ROM) in which a basic control program is recorded, an auxiliary memory device such as Hard Disk Drive (HDD) for memorizing various programs or data items, a display device for displaying various information items, and hardware resources such as an input and output I/F which is an interface with an input instrument such as a manipulation button or a touch panel used in an input manipulation by a manipulator, or a communication I/F which is an interface for performing wired or wireless communication with respect to other apparatuses.

Then, a program according to an exemplary embodiment of the invention is read out from the auxiliary memory apparatus or the like, installed in the RAM, and executed by the CPU, and thus each function of the failure predictive apparatus according to the exemplary embodiment of the invention is realized by the computer of the management unit 300.

Furthermore, in this example, a function of a storage unit according to the exemplary embodiment of the invention is realized by the model information storage unit 306, a function of an acquiring unit according to the exemplary embodiment of the invention is realized by the maintenance and Machine information collection unit 301, and a function of a calculation unit according to the exemplary embodiment of the invention is realized by the trouble predictor determination unit 307.

Here, the program according to the exemplary embodiment of the invention is set, for example, in the computer of the management unit 300 according to a method for reading out the program from an external memory medium such as a CD-ROM in which the program is memorized, a method for receiving the program through a communication network or the like, or the like.

Furthermore, the exemplary embodiment of the invention is not limited to an aspect in which each functional unit is realized by a software configuration as in this example, but each of the functional units may be realized by a dedicated hardware module.

In addition, in this example, each function of the failure predictive apparatus according to the exemplary embodiment of the invention is configured to be installed in one apparatus (the management unit 300), but each function may be configured to be dispersedly installed in plural apparatuses which are connected to be able to communicate with each other.

In addition, each function of the failure predictive apparatus according to the exemplary embodiment of the invention may be included in each of the image forming apparatuses 100, and each image forming apparatus 100 may calculate the failure occurrence probability with respect to the own device (a self-diagnosis), and in such a case, the management unit 300 may prepare the predictor determination model and the prior distribution model, and may deliver the models to the image forming apparatus 100 to be stored.

In addition, in the above description, the process of calculating the failure occurrence probability is described by taking the image forming apparatus 100 as an example, but other apparatuses in which the difference between the usages affects the failure occurrence probability may be the monitored apparatus, and a configuration in which the data necessary for calculating the failure occurrence probability is able to be collected from each apparatus may be used.

The exemplary embodiment of the invention is able to be used in various systems or apparatuses, and programs or methods thereof, or the like which perform the failure prediction with respect to the apparatus in which the difference between the usages affects the failure occurrence probability as the monitored apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A failure predictive system for predicting a failure in a monitored image forming apparatus, comprising:

a memory that stores a first model indicating a first data trend of control parameters used in operation control by the monitored image forming apparatus when a failure occurs in the monitored image forming apparatus, a second model indicating a second data trend of control parameters when the failure does not occur in the monitored image forming apparatus, and a third model indicating a relationship between data of usages of the monitored image forming apparatus and a probability of a failure occurred in the monitored image forming apparatus, which are models prepared in advance based on data acquired with respect to one or more monitored image forming apparatuses;

a processor configured to act as:

an acquiring unit that acquires data of the control parameters and the data of the usages with respect to the monitored image forming apparatus which is a failure predictive object, the control parameters being at least one of a charging voltage, a detected development bias, a detected intensity of laser light, and a detected toner density;

a calculation unit that calculates a failure occurrence probability of the monitored image forming apparatus which is the failure predictive object based on the detected data of the control parameters and the detected data of the usages acquired by the acquiring unit, and the first to the third models stored in the memory; and an output unit configured to output the calculated failure occurrence probability for use in determining a failure in the monitored image forming apparatus.

2. The failure predictive system according to claim 1, wherein the calculation unit:

computes a first probability of data of the control parameters when the failure occurs in the monitored image forming apparatus being in a same trend as the data of the acquired control parameters of the monitored image forming apparatus which is the failure predictive object using the first model, computes a second probability of data of the control parameters when the failure does not occur in the monitored image forming apparatus being in the same trend as the data of the acquired control parameters of the monitored image forming apparatus which is the failure predictive object using the second model, computes a third probability of a failure occurred in the monitored image forming apparatus under a same condition as the detected data of the acquired usages and a fourth probability of the failure not occurred in the monitored image forming apparatus under the same condition as the detected data of the acquired usages, using the third model, and calculates the failure occurrence probability of the monitored image forming apparatus which is the failure predictive object based on the first, the second, the third and the fourth probabilities.

3. The failure predictive system according to claim 1, wherein the third model is defined by associating a trouble occurrence probability calculated based on detected data of the monitored image forming apparatus which is coincident with a combination and the combination, the combination includes different types of units, and the unit is obtained by dividing a plurality of types of data which are different from each other for each usage.

4. The failure predictive system according to claim 2, wherein the third model is defined by associating a trouble occurrence probability calculated based on data of the monitored image forming apparatus which is coincident with a combination and the combination, the combination includes different types of units, and the unit is obtained by dividing a plurality of types of data which are different from each other for each usage.

5. The failure predictive system according to claim 1, wherein the memory stores the first to the third models for each type of failure, and the calculation unit calculates the failure occurrence probability of the monitored image forming apparatus which is the failure predictive object for each type of failure using the first to the third models corresponding to the type of failure.

6. The failure predictive system according to claim 2, wherein the memory stores the first to the third models for each type of failure, and the calculation unit calculates the failure occurrence probability of the monitored image forming apparatus which is the failure predictive object for each type of failure using the first to the third models corresponding to the type of failure.

7. The failure predictive system according to claim 3, wherein the memory stores the first to the third models for each type of failure, and the calculation unit calculates the failure occurrence probability of the monitored image forming apparatus which is the failure predictive object for each type of failure using the first to the third models corresponding to the type of failure.

8. The failure predictive system according to claim 4, wherein the memory stores the first to the third models for each type of failure, and the calculation unit calculates the failure occurrence probability of the monitored image forming apparatus which is the failure predictive object for each type of failure using the first to the third models corresponding to the type of failure.

9. The failure predictive system according to claim 1, further comprising:

a preparation unit that prepares the first to the third models based on data acquired with respect to the one or more monitored image forming apparatuses, wherein the memory stores the first to the third models prepared by the preparation unit.

10. The failure predictive system according to claim 2, further comprising:

a preparation unit that prepares the first to the third models based on data acquired with respect to the one or more monitored image forming apparatuses, wherein the memory stores the first to the third models prepared by the preparation unit.

11. The failure predictive system according to claim 3, further comprising:

a preparation unit that prepares the first to the third models based on data acquired with respect to the one or more monitored image forming apparatuses, wherein the memory stores the first to the third models prepared by the preparation unit.

12. The failure predictive system according to claim 4, further comprising:

a preparation unit that prepares the first to the third models based on data acquired with respect to the one or more monitored image forming apparatuses, wherein the memory stores the first to the third models prepared by the preparation unit.

13. The failure predictive system according to claim 5, further comprising:

a preparation unit that prepares the first to the third models based on data acquired with respect to the one or more monitored image forming apparatuses, wherein the memory stores the first to the third models prepared by the preparation unit.

14. The failure predictive system according to claim 6, further comprising:

a preparation unit that prepares the first to the third models based on data acquired with respect to the one or more monitored image forming apparatuses, wherein the memory stores the first to the third models prepared by the preparation unit.

15. The failure predictive system according to claim 7, further comprising:

a preparation unit that prepares the first to the third models based on data acquired with respect to the one or more monitored image forming apparatuses, wherein the memory stores the first to the third models prepared by the preparation unit.

16. The failure predictive system according to claim 8, further comprising:

a preparation unit that prepares the first to the third models based on data acquired with respect to the one or more monitored image forming apparatuses, wherein the memory stores the first to the third models prepared by the preparation unit.

17. The failure predictive system according to claim 1, wherein the memory:

derives a first histogram based on the control parameters obtained by being preceded for a predetermined period from a time when a failure occurs, and stores the first model obtained based on the first histogram, and derives a second histogram based on the control parameters obtained by a period other than the predetermined period, and stores the second model obtained based on the second histogram.

18. The failure predictive system according to claim 17, wherein the memory:

stores the first model obtained by averaging the first histogram, and stores the second model obtained by averaging the second histogram.

19. A failure predictive apparatus for predicting a failure in a monitored image forming apparatus, comprising:

a memory that stores a first model indicating a data trend of control parameters used in operation control by the monitored image forming apparatus when a failure occurs in the monitored image forming apparatus, a second model indicating a data trend of control parameters when the failure does not occur in the monitored image forming apparatus, and a third model indicating a relationship between data of usages of the monitored image forming apparatus and a probability of a failure occurred in the monitored image forming apparatus, which are models prepared in advance based on data acquired with respect to one or more monitored image forming apparatuses;

a processor configured to act as:

an acquiring unit that acquires detected data of the control parameters and the detected data of the usages with respect to the monitored image forming apparatus which is a failure predictive object, the control parameters being at least one of a charging voltage, a detected development bias, a detected intensity of laser light, and a detected toner density;

a calculation unit that calculates a failure occurrence probability of the monitored image forming apparatus which is the failure predictive object based on the detected data of the control parameters and the detected data of the usages acquired by the acquiring unit, and the first to the third models stored in the memory; and an output unit configured to output the calculated failure occurrence probability for use in determining a failure in the monitored image forming apparatus.

* * * * *